US005638992A

United States Patent [19]

Lim et al.

[11] Patent Number: 5,638,992

[45] Date of Patent: Jun. 17, 1997

[54] MULTI-COMPARTMENT PRESSURIZED MIXING DISPENSER

[76] Inventors: Walter K. Lim, 14720 Horicultural Dr., Hacienda Heights, Calif. 91745; Arthur A. Krause, 20642 Skouras Dr., Canoga Park, Calif. 91306

[21] Appl. No.: 501,665

[22] Filed: Jul. 12, 1995

[51] Int. Cl.[6] ..... B67D 5/56

[52] U.S. Cl. ..... 222/129; 222/135; 222/402.1

[58] Field of Search ..... 222/129, 135, 222/394, 402.1, 541.3, 215

[56] References Cited

U.S. PATENT DOCUMENTS

| | | | |
|---|---|---|---|
| 4,399,158 | 8/1983 | Bardsley et al. | 222/129 X |
| 5,082,146 | 1/1992 | Hardt | 222/135 |

*Primary Examiner*—Gregory L. Huson
*Attorney, Agent, or Firm*—Dennis H. Lambert

[57] ABSTRACT

An apparatus and method for containing, mixing and dispensing multiple component products, wherein the components are maintained separate from one another until immediately prior to use, and the components are then mixed together to form a product for use. The apparatus includes a pressurized outer container for holding a primary component, and a pressurized inner container supported inside the outer container for holding a secondary component separate from the primary component. The inner container is openable when the pressure inside the inner container exceeds that in the outer container by a predetermined amount, whereby the interiors of the inner and outer containers are in communication with one another to enable admixture of the two components. In use, the primary component is introduced into the outer container and pressurized to a predetermined pressure. The secondary component is then introduced into the inner container and pressurized to a predetermined pressure less than the pressure in the outer container. When it is desired to admix the two components and dispense the resulting product, the outer container is inverted and part of the pressure therein released, until the pressure in the inner container exceeds that in the outer container by a predetermined amount, whereupon the inner container opens and the two components are admixed.

8 Claims, 5 Drawing Sheets

FIG. 3
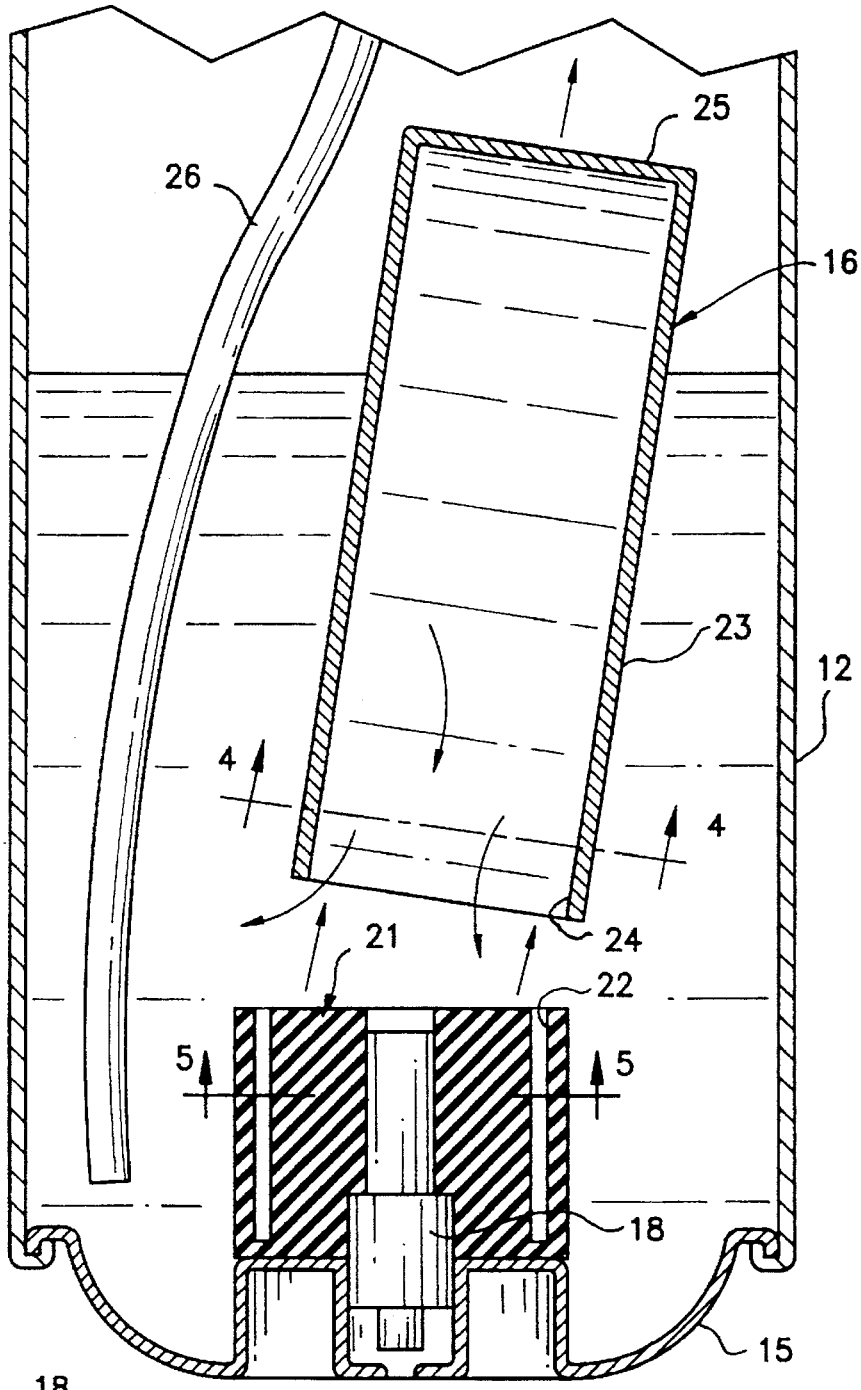
FIG. 5
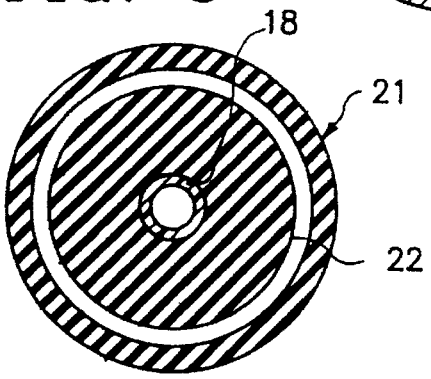
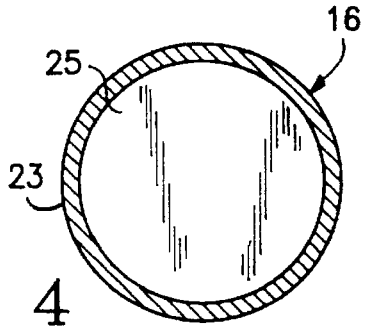
FIG. 4

MULTI-COMPARTMENT PRESSURIZED MIXING DISPENSER

FIELD OF THE INVENTION

This invention relates generally to pressurized containers for dispensing consumer products, and includes pressurized aerosol dispensers. More particularly, the invention is directed to a pressurized dispensing container having means for holding in separate compartments at least two components that cannot generally be mixed together until shortly before use, and includes means for admixing the components when desired, and discharging the mixed components for use.

BACKGROUND OF THE INVENTION

Self-contained pressurized dispensers are a convenient way to dispense products for use, and many consumer products are packaged in such dispensers, including hair spray, cleaning products, paint, adhesives, insect repellents, and the like. Conventional pressurized dispensers typically comprise a metal container having a bottom wall and a top wall, with a combined fill and discharge valve mounted in the top wall. A product to be dispensed is held within the container, along with a suitable propellant, whereby the contents of the container are under pressure and when the discharge valve is actuated the product is dispensed through the valve. Many such dispensers comprise aerosol dispensers which emit a fine spray of product, although others may discharge a foam or gel, or even a liquid stream. Moreover, although some prior art pressurized dispensing containers have means for holding plural products in separate compartments and admixing them as they are discharged, most prior art pressurized dispensing containers hold only a single product.

Many products, such as urethane and epoxy paints, two component adhesives, and some hair dyes, for example, require two components to be mixed together before the product is suitable for use. However, the components generally cannot be mixed together until shortly before use because they will react with another when mixed together and will become unsuitable for use relatively quickly. For instance, one of the components in many two component products includes a catalyst. Because of the requirement to maintain these multiple component products separate from one another until they are ready for use, and the previous unavailability of a suitable pressurized dispensing container for holding these components in separate compartments and then admixing them when desired just prior to use, such products have typically been packaged and sold in separate containers and then mixed just prior to use. Accordingly, they have generally not been suitable for use in the more convenient pressurized dispensing containers.

There is thus need for an inexpensive, reliable and easy-to-use pressurized dispensing container which has means for holding plural components in separate compartments and then admixing the components when desired just prior to use.

SUMMARY OF THE INVENTION

It is, therefore, an object of this invention to provide a pressurized dispensing container for holding and dispensing plural components which are maintained separate from one another until ready for use, and then are mixed together in the container prior to discharge.

Another object of the invention is to provide a pressurized aerosol dispenser for containing in separate compartments the multiple components of a multiple component product that must be mixed together prior to use, and which includes means for admixing the components prior to discharge of the product.

A further object of the invention is to provide a pressurized dispensing container for holding in separate compartments multiple components which must be mixed together to form a usable product, and wherein the components are mixed together in the container prior to discharge of the product and without requiring the use of mixing valves and other conventional means used in the prior art to mix multiple component products.

A still further object of the invention is to provide a pressurized dispensing container for holding a product to be dispensed, wherein a separate frangible inner compartment is within the container for holding a component to be mixed with the product prior to discharge, with means for releasing the component from the inner compartment into the product in the container when desired.

These and other objects and advantages of the invention are achieved by a container which holds, under pressure, a primary product to be dispensed, and which has therein a smaller secondary container holding a component to be mixed with the primary product prior to discharge of the product, and wherein the secondary container includes a frangible portion which is operative to release the component therefrom when the pressure within the primary container falls below a predetermined level. In use, the pressure within the primary container is greater than the pressure within the secondary container so that the integrity of the secondary container is maintained and the products are kept separate from one another. When it is desired to mix the component in the secondary container with the primary product in the primary container, at least part of the pressure is released from the primary container, whereby the pressure in the secondary container exceeds that in the primary container, and the secondary container is then operative to release the component therefrom into the primary product for admixture therewith.

In one form of the invention, the secondary container has an open end which is frictionally received on a member in the primary container, and when the pressure differential between the primary container and the secondary container reaches a predetermined level, the greater pressure within the secondary container overcomes the frictional engagement and dislodges the secondary container from the structure in the primary container, enabling the material therein to flow through the open end of the secondary container into the primary product.

In another form of the invention, the secondary container has a frictionally retained plug which is dislodged when the pressure in the secondary container exceeds that in the primary container by a predetermined amount, whereby the material in the secondary container flows through the opening left by the dislodged plug and mixes with the primary product in the primary container.

Yet another form of the invention includes an expandable secondary container, whereby it is adapted to hold differing quantities of material to be admixed with the primary product. This expandable member or chamber includes means to release the material therefrom when the pressure within the expandable chamber exceeds that in the primary chamber by a predetermined amount. In one embodiment, the expandable chamber incudes a frangible section which breaks when the predetermined pressure is reached.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein:

FIG. 3 is an enlarged fragmentary view in section of a portion of the apparatus of FIG. 2, showing the secondary container dislodged from its mount to enable admixture of the material contained therein with the primary product contained held in the primary container;

FIG. 4 is transverse sectional view taken along line 4—4 in FIG. 3;

FIG. 5 is a traverse sectional view taken along line 5—5 in FIG. 3;

DETAILED DESCRIPTION OF THE PREFERRED EMBODIMENTS

Figure 1:
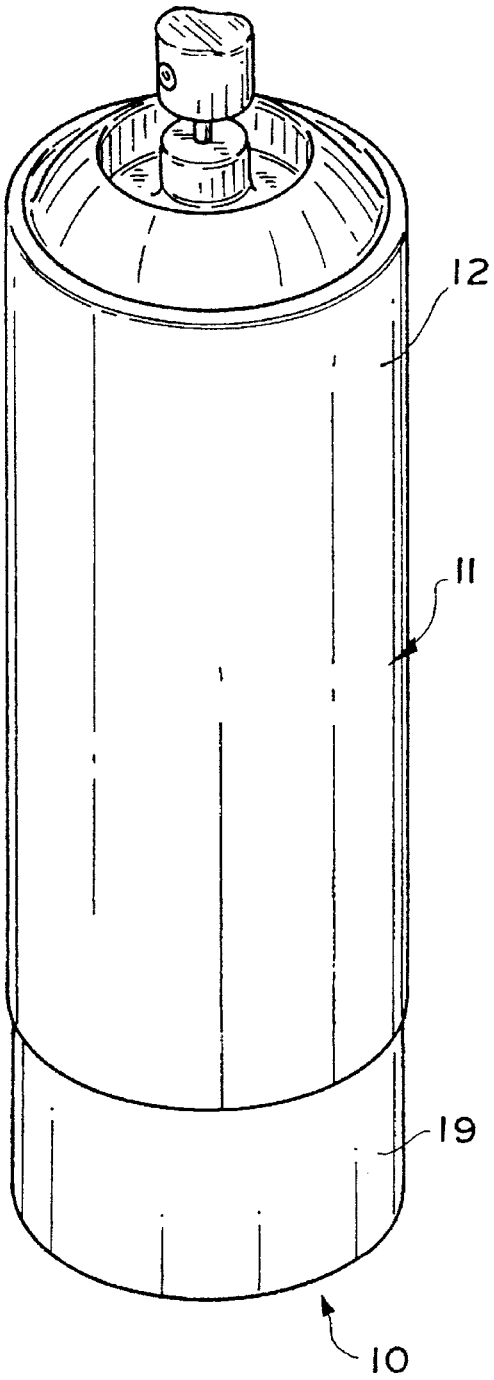
FIG. 1 is a front, top perspective view of a pressurized dispensing container according to the invention.
Figure 2:
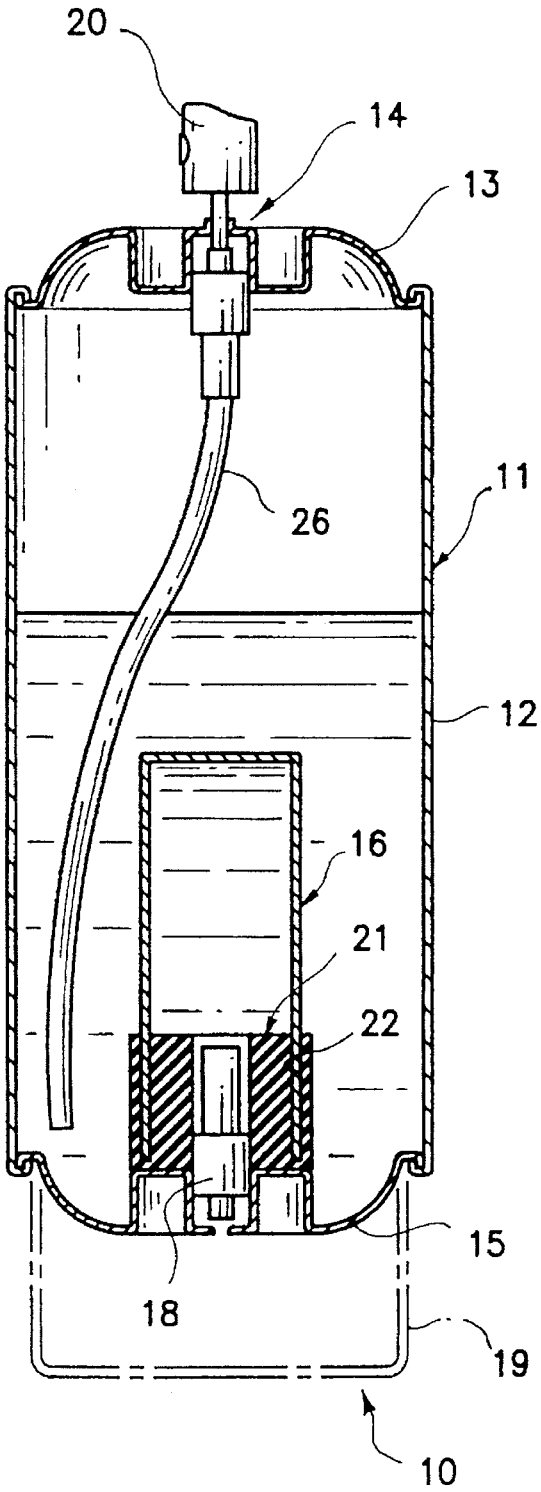
FIG. 2 is a longitudinal sectional view of the device of FIG. 1.

Referring more specifically to the drawings, a first form of pressurized dispensing container according to the invention is indicated generally at 10 in FIGS. 1–5. In this form of the invention, the dispenser is depicted as an aerosol dispenser comprising a container 11 having a cylindrical side wall 12 with an end wall 13 secured in a top end thereof, and a combined fill and discharge valve assembly 14 secured in the top wall 13. The side wall 12, end wall 13 and valve 14 are of conventional construction, and in the form of the invention shown, the side wall and end wall are formed of a suitable metal, such as steel.

The invention departs from conventional aerosol dispensers, however, in the provision of a modified bottom wall 15 which carries an inner, secondary chamber 16 and an associated fill valve 18. A locking over-cap 19 is preferably placed over the bottom end of the dispenser to protect and prevent access to the fill valve 18. A conventional over-cap (not shown) may also be provided on the top end of the container to protect the discharge valve 14.

The bottom end wall 15 is substantially identical to the top end wall 13, and is secured to the can side wall 12 in the same way, i.e., by crimping or other conventional means. The fill valve 18 is also of conventional construction, and is identical to the valve used in the assembly 14 at the top end of the container, except that it does not have the discharge button 20 assembled thereto for opening the valve to discharge product.

A resilient plug 21 is frictionally engaged on the valve 18, and has a cylindrically shaped annular recess 22 formed therein, opening toward the interior of the container. The plug 21 is preferably made of a fluorinated neoprene rubber to make it resistent to solvents that may be used in products dispensed from the container.

The inner container 16 comprises an elongate cylindrical side wall 23 having an open end 24 and a closed end wall 25. The container 16 may be made of any suitable material, such as aluminum. The open end of the side wall 23 is frictionally engaged in the annular channel 22 of plug 21 and is held to the plug with considerable frictional force. The frictional engagement between the wall 23 and the plug 21 also creates an effective seal between the inner container 16 and the outer container 11.

The container 11 is manufactured in accordance with conventional techniques, and the can manufacturer assembles the bottom wall 15 and associated fill valve 18, plug 21, and inner container 16 prior to shipment of the container to a facility at which the inner and outer containers are filed with product to be dispensed. The filler may evacuate the inner container 16 by applying a vacuum through the valve 18. Evacuation of the inner container holds it more firmly to the plug 21 and effects a better seal with the plug during subsequent handling.

The primary component of a two-component product is then introduced into the outer container through the valve assembly 14. A suitable propellant is also introduced into the outer container along with the primary product. In a conventional system, the primary product may occupy two-thirds to one-half of the interior volume of the outer container. The space above the level of liquid product in the outer container may be charged with an inert gas such as nitrogen for producing additional pressure on the contents of the outer container. For example, the pressure in the outer container may be any suitable value, but is typically in the range of from about 85 p.s.i. to about 95 p.s.i.

After filling the outer container with the primary product and propellant, and any additional pressurizing gas, the filler next introduces the secondary component via the fill valve 18 into the inner container 16. The secondary component introduced into the inner container may comprise a catalyst for the primary product, and additional propellant. The products in the outer container and the inner container may comprise any components that are typically mixed in two-component products to form a product ready for use, but which cannot be mixed until shortly before use. Examples are two-component adhesives, urethane and epoxy paints, hair coloring products, and the like.

When the consumer is ready to use the dispenser of the invention, the dispenser is inverted so that the product occupies the space adjacent end wall 13, while the gaseous propellant occupies the space adjacent bottom wall 15 (it being understood that the "bottom" wall 15 comprises the top wall with the container in its inverted position). In this position, the dip tube 26 extends into space occupied by the gaseous propellant. Thus, when the discharge valve 14 is opened by depressing button 20, the gaseous propellant is discharged, thereby reducing the pressure in the outer container. When the pressure differential between the inner and outer containers is in the range of from about 5 p.s.i. to 15 p.s.i. and preferably about 10 p.s.i., the greater pressure in the inner container 16 overcomes the frictional engagement between container 16 and plug 21, whereby the inner container pops off of the plug 21, exposing the interior of container 16 to the interior of container 11, and enabling the two components in the respective containers to mix with one another. The additional propellant contained in the inner container effectively raises the pressure in the outer container to a normal range, i.e., about 85 p.s.i. to about 90 p.s.i, for satisfactory discharge of the product when valve 14 is opened. The head space provided by the gaseous propellant enables the products to be thoroughly agitated and mixed together by shaking the container.

The relative sizes of the inner and outer containers can be in any suitable proportion, depending upon the products to be dispensed. For instance, some two-component paints typically require a ratio of paint to catalyst of from 4:1 to 8:1. Thus, the inner container could bear a similar dimensional relationship to the outer container, although it is also possible that a measured amount of product could be introduced into a constant-size inner container 16.

At the present time, it is contemplated that the inner container 16 will be made of aluminum, although it is possible that other suitable materials could be used for the inner container and the plug 21. For instance, both of these items could be made of a suitable plastic material, if desired.

Figure 6:
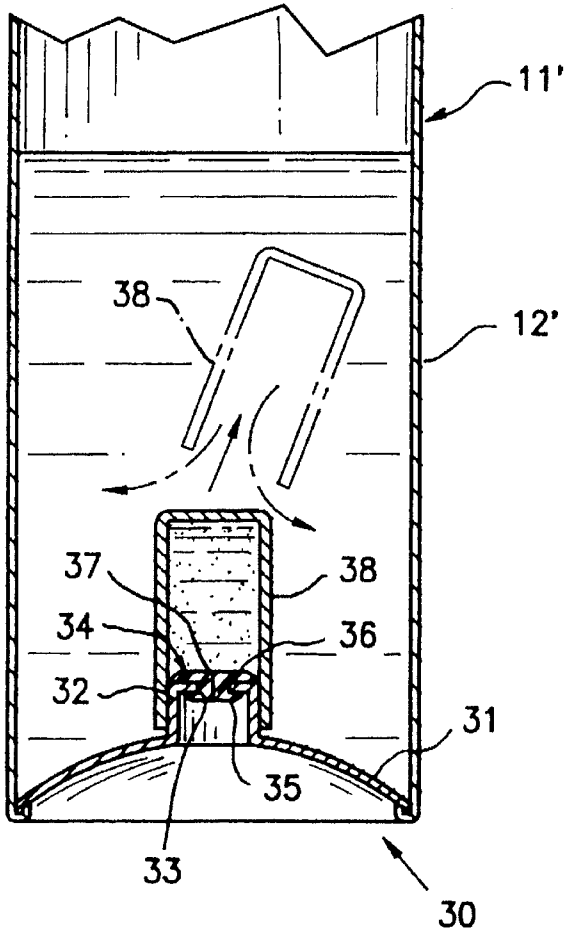
FIG. 6 is a fragmentary sectional view of a modified dispensing container according to the invention, wherein a different arrangement is provided in the bottom of the primary container for holding the secondary container, and which includes a different type of fill valve for introducing product into the secondary container.

A first modification of the invention is indicated generally at 30 in FIG. 6. In this form of the invention, the primary container 11', including its side wall 12, may be manufactured from a suitable plastic material. An essentially conventional top wall and valve assembly (not shown), such as 13 and 14 in that form of the invention illustrated in FIGS. 1–3, for example, may be assembled to the top end of side wall 12' by crimping or other suitable means. Further, in this form of the invention the bottom wall 31 has a convex domed configuration with a reduced diameter cylindrically shaped wall 32 projecting inwardly of the container and having an opening 33 formed through its center.

A resilient plug 34 is fitted in the opening 33 and has an outer annular flange 35 engaged against the underside or outer surface of the wall surrounding opening 33, and a diametrically larger annular flange 36 engaged against the inner surface of the upstanding wall member 32 in surrounding relationship to the opening 33. A normally closed opening 37 extends through the plug 34 for receipt of a needle or similar implement used to introduce material into the inner container.

The inner container 38 is substantially identical to the container 16 described in the first form of the invention, and includes an open end frictionally engaged over the wall 32.

In all other respects, this form of the invention functions identically to that previously described, i.e., product is introduced into the inner container 38 via the plug type fill valve 34, and the inner container 38 is dislodged from the wall 32 to enable admixing of the product contained therein with the product held in the primary container when the pressure differential between the inner container and primary or outer container 11' reaches a predetermined value, e.g., 10 p.s.i.

Figure 7:
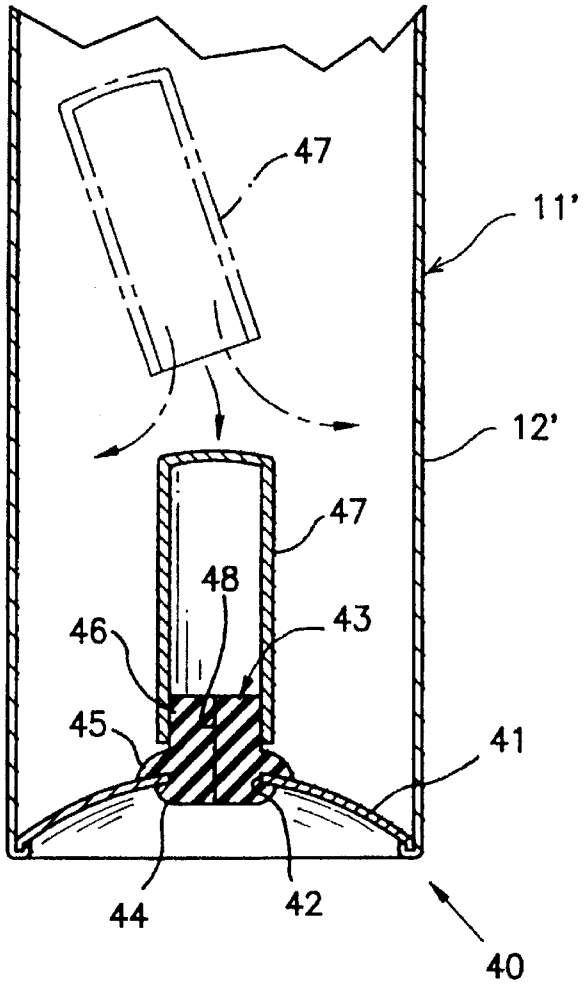
FIG. 7 is a fragmentary sectional view similar to FIG. 6 of another form of the invention, wherein the secondary container is held on the fill valve used to introduce material into the secondary container.

A second modification of the invention is indicated generally at 40 in FIG. 7. In this form of the invention, the bottom wall 41 has a convex domed configuration similar to that shown in FIG. 6, but rather than the upstanding cylindrical wall portion 32, the wall 41 has a central opening 42 formed therein, and a resilient plug 43 is secured within the opening by engagement of flanges 44 and 45 on the opposite sides of the wall 41 around the opening. The plug itself is formed with an upstanding cylindrical projection 46 for frictional engagement with the open end of inner container 47, and a normally closed opening 48 extends through the plug to enable product to be introduced into the inner container 47 by inserting a needle or like implement through the opening 48.

In all other respects, this form of the invention functions identically to those forms previously described, i.e., when the pressure differential between the inner container and outer container reaches a predetermined value, e.g., 10 p.s.i., the inner container is dislodged from its frictional engagement with the upstanding projection 46, whereby the material contained within the inner container is enabled to mix with the material contained in the outer container.

Figure 8:
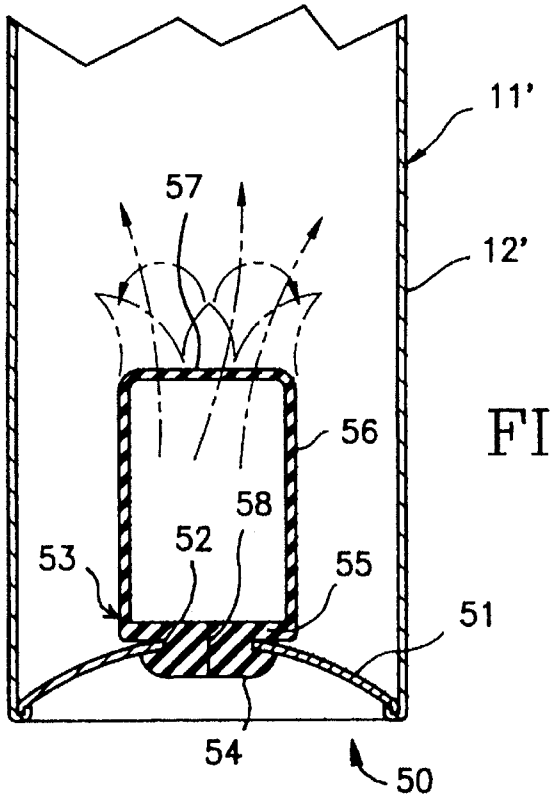
FIG. 8 is a fragmentary sectional view of still another form of the invention, wherein the secondary container and fill valve are formed as a unit, and the secondary container includes a frangible section which ruptures to release product therefrom.

A third modification of the invention is indicated generally at 50 in FIG. 8. In this form of the invention, a convex domed bottom wall 51 substantially identical to the wall 41 in the previous form of the invention is secured in the bottom end of side wall 12' of container 11', and this wall 51 has a central opening 52 formed therethrough. A unitary or integrally formed combined plug and inner container 53 is secured within the opening 52. The combined plug and inner container includes an outer flange 54 which engages against the outer surface or underside of wall 51 around the opening 52, and an inner annular wall 55 engaged against the inner surface of wall 51 in surrounding relation to the opening 52. An upstanding cylindrical side wall 56 extends into the interior of container 11' from the outer periphery of wall 55 and terminates at its upper end in an end wall 57 having a plurality of frangible score lines 58 formed therein. A normally closed opening 59 is formed through the plug end of the combination plug and inner container member 53 to enable product to be introduced into the inner container by use of a needle or other suitable implement.

In use, when the pressure differential between the inner container and the outer container reaches a predetermined value, e.g., 10 p.s.i., the frangible score lines rupture, enabling the end wall 57 to burst outwardly, resulting in the material in the inner container mixing with that in the outer container. In all other respects, this form of the invention functions the same as those previously described.

Figure 10:
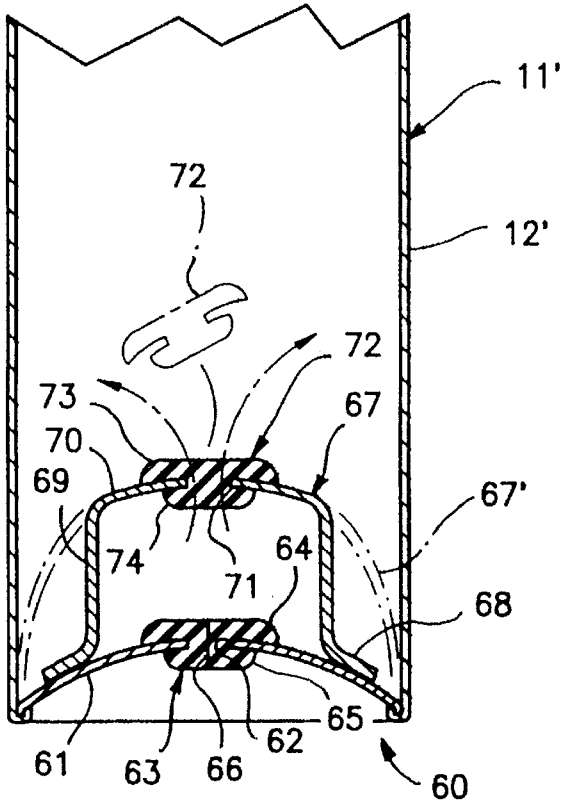
FIG. 10 is a fragmentary sectional composite view showing in full lines a still further variation of the invention, wherein a displacable plug is provided in an end wall of the secondary container, which is fixed to the primary container, and showing in dot-and-dash lines a variation for attachment of the wall of the secondary container to the wall of the primary container.
Figure 9:
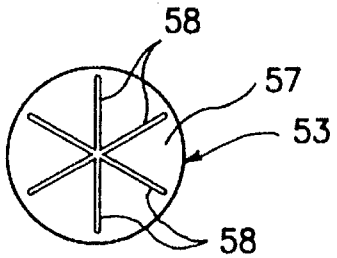
FIG. 9 is an end view of the secondary container of FIG. 8.

A fourth modification of the invention is indicated generally at 60 in FIG. 10. In this form of the invention, a convex domed wall 61 is secured in the bottom end of container side wall 12', as in the previously described forms of the invention, and the wall 61 has a central opening 62 formed therethrough.

A resilient plug 63 similar to 34 described in relation to FIG. 6 is fitted within the opening 62 and is secured in place by inner and outer flanges 64 and 65, respectively. A normally closed opening 66 is formed through the plug 63 to receive a needle valve or other implement as described in connection with the previous forms of the invention.

An inner container 67 is secured to the bottom wall 61 by means of a radially outwardly extending foot flange 68 that is welded or otherwise suitably secured to the end wall 61 during manufacture of the can, and before assembly of the end wall 61 to the side wall 12'. The inner container 67 includes a cylindrical side wall 69 projecting interiorly of the container 11' from the foot flange 68, and terminates in an end wall 70 having a central opening 71 formed therethrough.

A resilient plug 72 is secured in the opening 71 by means of inner and outer radially extending flanges 73 and 74. It will be noted that the flange 73 is larger than the flange 74, whereby the plug 72 will not be displaced inwardly into the inner container 67, but can be displaced outwardly, as shown by dot and dashed lines, when the pressure differential between the inner container and the outer container reaches a predetermined valve, e.g., 10 p.s.i.

A slight variation of this form of the invention is shown at 67' in dot and dash lines, wherein the inner container wall extends outwardly to the bottom edge of the side wall 12' of the outer container, and is crimped thereto, rather than utilizing a foot flange welded to the bottom wall 61 as previously described. In this form of the invention, both the inner container 67' and the bottom wall 61 would be crimped at their outer edges to the bottom end of the side wall 12 of the outer container.

Figure 13:
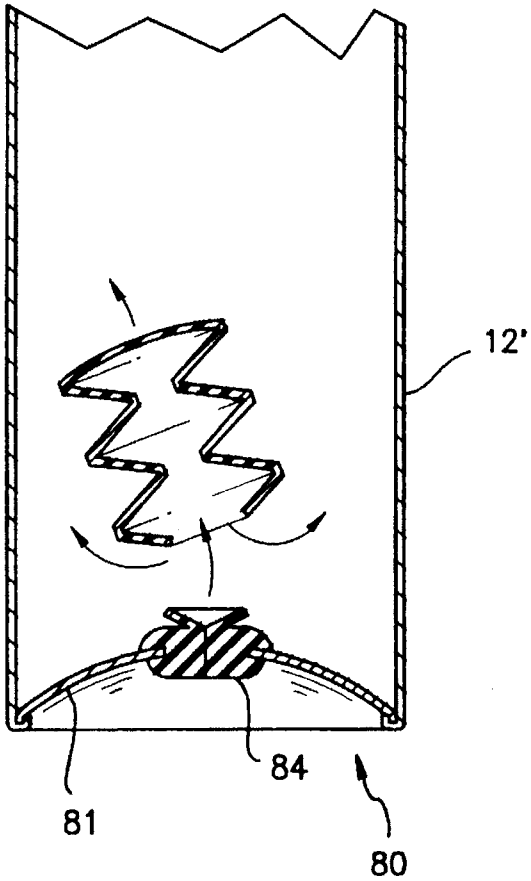
FIGS. 11, 12 and 13 are fragmentary sectional views of yet another form of the invention, wherein the secondary container comprises an expandable member so that it can be used to hold a relatively small quantity of product as seen in FIG. 11, or a greater quantity of product as seen in FIG. 12, and which includes a frangible section so that the expandable member separates from its base to release product therefrom into the primary container when the pressure in the secondary container exceeds that in the primary container by a predetermined amount.
Figure 12:
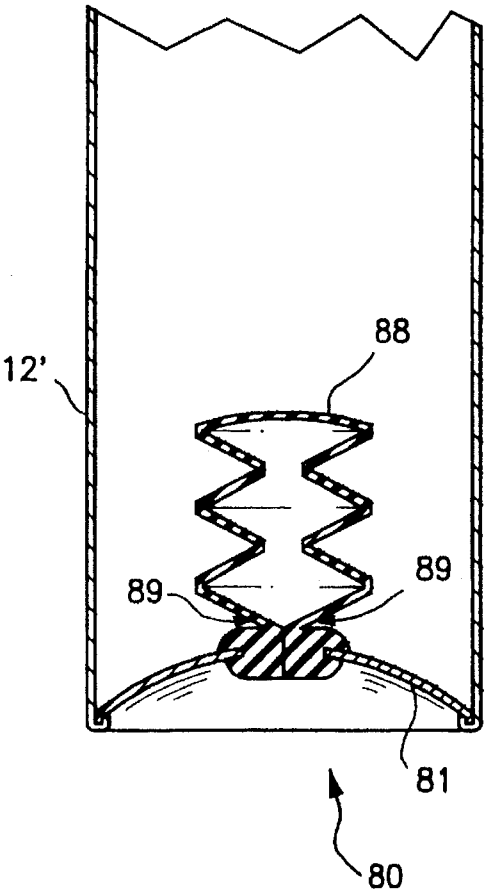
Figure 11:
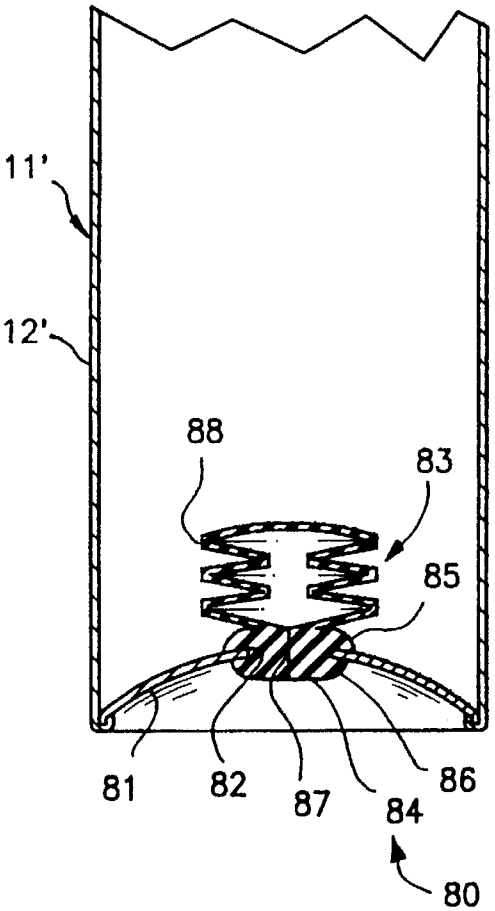

A fifth embodiment of the invention is indicated generally at 80 in FIGS. 11, 12 and 13. In this form of the invention, a convex domed bottom wall 81 is secured to the bottom end of side wall 12' of container 11' by any suitable means, such as crimping or the like. The bottom wall has a central opening 82 formed therethrough, and a combined plug, fill valve and inner container 83 is secured in the opening 82 similarly to that form of the invention shown in FIG. 8. The plug 84 has inner and outer flanges 85 and 86 disposed on opposite sides of the wall 81 in surrounding relation to the opening 82 for securing the combination valve and inner container 83 to the wall 81. A normally closed opening 87 is formed through the plug 84 for receipt of a needle or other suitable implement to introduce material into the inner container.

The container 88 comprises a bellows-like structure that is capable of expanding to hold different quantities of material to be admixed with the material contained in the outer container 11'. Thus, as seen in FIG. 11, the bellow-like container 88 is essentially collapsed, defining a relatively small interior volume, while in FIG. 12 it is shown expanded, defining a relatively large interior volume. With this structure, the same interior container structure 88 may be used to hold different quantities of material, ranging, e.g., from about one-quarter ounce up to about one and one-half ounces, simply by injecting a desired quantity of material into the container 88, expanding it to the necessary volume.

A frangible score line or weakened area 89 is formed around the base of the bellows member 88 so that when the pressure differential between the inner container and the outer container exceeds a predetermined value, the bellows member separates from the plug 84, as seen in FIG. 13, to enable the contents of the bellows member to flow into and mix with the contents of the outer container 11'.

The combined valve, plug and inner container assembly 83 may be unitarily formed in one piece from any suitable material such as metal, rubber or plastic, depending upon the performance characteristics desired and the materials being handled by the device.

The present invention thus provides a simple and economical arrangement for holding two separate components in separate compartments and for enabling them to be relatively easily mixed together just prior to dispensing the mixed components from the container.

While particular embodiments of the invention have been illustrated and described in detail herein, it should be understood that various changes and modifications may be made to the invention without departing from the spirit and intent of the invention as defined by the scope of the appended claims.

What is claimed is:

1. A pressurized dispensing container for dispensing a product under pressure, wherein the product comprises multiple components that are maintained separate from one another until just prior to use and are then mixed together before the product is dispensed for use, comprising:

(a) an outer container for holding a primary component of the product to be dispensed;

(1) said outer container having a side wall, opposite end walls, and a discharge valve for dispensing product from the outer container;

(2) means for pressurizing the contents of the outer container to cause the contents to be discharged under pressure from the container when the discharge valve is opened;

(b) an inner container supported in the outer container for holding a quantity of a secondary component to be mixed with the primary component in the outer container to form the product to be dispensed prior to discharge of the product;

(1) said inner container having wall means defining a separate chamber for holding the secondary component separate from the primary component and preventing admixture therebetween; and (2) said inner container wall means having an end that is normally attached and sealed to a wall means of the outer container, and said inner container wall means being separable from the outer container wall means to expose the interior of the inner container to the interior of the outer container when the pressure in the inner container exceeds the pressure in the outer container by a predetermined value, thereby enabling admixture of the primary and secondary components.

2. A pressurized dispensing container as claimed in claim 1, wherein:

the inner container wall means is expandable to hold different quantities of said secondary component.

3. A pressurized dispensing container as claimed in claim 2, wherein:

said inner container wall means comprises a bellows-like member.

4. A pressurized dispensing container as claimed in claim 3, wherein:

said outer container has an end wall with an opening formed therethrough, and a resilient plug is secured and sealed in said opening, said bellows-like member being joined to said plug by a frangible section, whereby the bellows-like member separates from the plug to expose the interior of the inner container to the interior of the outer container when the pressure in the inner container exceeds the pressure in the outer container by a predetermined value, thereby enabling admixture of the primary and secondary components.

5. A pressurized dispensing container as claimed in claim 1, wherein:

said outer container has an end wall with an opening formed therethrough;

a normally closed fill valve means is secured in said opening to enable said secondary component to be introduced into the inner container; and a resilient plug is secured on said valve means inside said outer container, said inner container walls means including a wall having an open end secured and sealed to said plug, and being displaceable from said plug to expose the interior of the inner container to the interior of the outer container when the pressure in the inner container exceeds the pressure in the outer container by a predetermined value, thereby enabling admixture of the primary and secondary components.

6. A pressurized dispensing container as claimed in claim 5, wherein:

said plug has an annular channel therein opening interiorly of the outer container; and said inner container open end is normally frictionally received and held in said channel, and is separable therefrom to expose the interior of the inner container to the interior of the outer container when the pressure in the inner container exceeds the pressure in the outer container by a predetermined value, thereby enabling admixture of the primary and secondary components.

7. A pressurized dispensing container for dispensing a product under pressure, wherein the product comprises multiple components that are maintained separate from one another until just prior to use and are then mixed together before the product is dispensed for use, comprising:

(a) an outer container for holding a primary component of the product to be dispensed;

(1) said outer container having a side wall, opposite end walls, and a discharge valve for dispensing product from the outer container;

(2) means for pressurizing the contents of the outer container to cause the contents to be discharged under pressure from the container when the discharge valve is opened;

(b) an inner container supported in the outer container for holding a quantity of a secondary component to be mixed with the primary component in the outer container to form the product to be dispensed prior to discharge of the product;

(1) said inner container having wall means defining a separate chamber for holding the secondary component separate from the primary component and preventing admixture therebetween; and (2) a self-sealing plug secured in an end wall of the outer container in position to communicate with the interior of the chamber defined by the inner container wall means, said plug adapted to receive therethrough a hollow needle or similar implement to enable said secondary component to be introduced into the inner container; and (3) said inner container wall means being formed integrally with said plug and including a frangible portion which breaks to expose the interior of the inner container to the interior of the outer container when the pressure in the inner container exceeds the pressure in the outer container by a predetermined value, thereby enabling admixture of the primary and secondary components.

8. A pressurized dispensing container for dispensing a product under pressure, wherein the product comprises multiple components that are maintained separate from one another until just prior to use and are then mixed together before the product is dispensed for use, comprising:

(a) an outer container for holding a primary component of the product to be dispensed;

(1) said outer container having a side wall, opposite end walls, and a discharge valve for dispensing product from the outer container;

(2) means for pressurizing the contents of the outer container to cause the contents to be discharged under pressure from the container when the discharge valve is opened;

(b) an inner container supported in the outer container for holding a quantity of a secondary component to be mixed with the primary component in the outer container to form the product to be dispensed prior to discharge of the product;

(1) said inner container having wall means defining a separate chamber for holding the secondary component separate from the primary component and preventing admixture therebetween; and (2) said inner container wall means having an end that is normally attached and sealed to a wall means of the outer container; and (3) said inner container wall means having an opening formed therethrough, and a displaceable plug normally secured in said opening and sealing said opening to prevent communication between the interiors of the inner container and the outer container, said plug being displaceable from said opening to expose the interior of the inner container to the interior of the outer container when the pressure in the inner container exceeds the pressure in the outer container by a predetermined value, thereby enabling admixture of the primary and secondary components.

* * * * *